US007805101B2

(12) United States Patent
DiRubio et al.

(10) Patent No.: US 7,805,101 B2
(45) Date of Patent: Sep. 28, 2010

(54) MULTI-COLOR PRINTING SYSTEM AND METHOD FOR HIGH TONER PILE HEIGHT PRINTING

(75) Inventors: Christopher A. DiRubio, Webster, NY (US); Michael J. Martin, Hamlin, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 12/760,874

(22) Filed: Apr. 15, 2010

(65) Prior Publication Data

US 2010/0196069 A1 Aug. 5, 2010

Related U.S. Application Data

(62) Division of application No. 12/136,414, filed on Jun. 10, 2008, now Pat. No. 7,747,210.

(51) Int. Cl.
*G03G 13/01* (2006.01)

(52) U.S. Cl. ..... 399/308; 399/87; 399/299; 399/301; 399/302; 399/306

(58) Field of Classification Search ..... 399/82, 399/85, 87, 299, 301, 302, 306, 308, 309
See application file for complete search history.

(56) References Cited

U.S. PATENT DOCUMENTS

| | | | | |
|---|---|---|---|---|
| 4,941,023 | A * | 7/1990 | Holmes et al. | 399/364 |
| 5,999,201 | A * | 12/1999 | Dalal et al. | 347/115 |
| 7,575,232 | B2 | 8/2009 | Willis | |
| 2004/0228653 | A1 | 11/2004 | Yoshino | |
| 2005/0074260 | A1 | 4/2005 | King et al. | |
| 2006/0222388 | A1 | 10/2006 | DiRubio | |
| 2007/0081064 | A1 | 4/2007 | Spencer et al. | |
| 2007/0081828 | A1 | 4/2007 | Radulski et al. | |
| 2007/0120935 | A1 | 5/2007 | Willis | |
| 2008/0317505 | A1 | 12/2008 | Kuo et al. | |
| 2009/0267285 | A1 | 10/2009 | Willis | |
| 2009/0304408 | A1 * | 12/2009 | DiRubio et al. | 399/82 |

* cited by examiner

*Primary Examiner*—David P Porta
*Assistant Examiner*—Casey Bryant
(74) *Attorney, Agent, or Firm*—Fay Sharpe LLP

(57) ABSTRACT

Methods are presented in which one or more pages of a print job are segmented into two or more parts, with the first part being transferred and affixed to the printed medium prior to transferring and affixing the second part, in order to facilitate high TMA (pile height) printing while mitigating adverse retransfer, blur, fusing, and hollow character effects.

20 Claims, 9 Drawing Sheets

MULTI-COLOR PRINTING SYSTEM AND METHOD FOR HIGH TONER PILE HEIGHT PRINTING

REFERENCE TO RELATED APPLICATION

This application is a divisional of, and claims priority to and the benefit of, U.S. patent application Ser. No. 12/136,414, which was filed Jun. 10, 2008 now U.S. Pat. No. 7,747,210, entitled MULTI-COLOR PRINTING SYSTEM AND METHOD FOR HIGH TONER PILE HEIGHT PRINTING, the entirety of which is hereby incorporated by reference.

BACKGROUND

The present exemplary embodiment relates to document processing systems such as printers, copiers, multi-function devices, etc., and more particularly to mitigation of retransfer, blur, and hollow character effects in printing high toner mass per unit area (TMA) print jobs. Toner-based Xerographic printing systems often suffer from limitations regarding the transfer and fusing of high TMA images in which toner of several colors is to be transferred to a given portion of an image. For instance, hexachrome printing in systems that employ four or more colors can result in certain areas of an image requiring toner from four or more xerographic stations. Proposed systems may include six such stations/engines, for creation of two spot or gamut extension colors in addition to cyan (C), magenta (M), yellow (Y) and black (K). A six color image is created on an intermediate transfer belt (ITB) in six successive transfer nips, one for each color separation. For areas in which most or all the toner colors are to be applied, however, the ITB will end up with a high pile of toner. Retransfer problems occur when toner on the intermediate belt is wholly or partially removed (scavenged) through interaction with downstream transfer nips, whereby the desired amount of one or more colors does not get transferred to the final printed sheet. Due to the physical interaction of the toner on the intermediate transfer belt and the xerographic stations, the retransfer problem worsens as the number of colors increases, with jobs requiring the use of a large number of colors leading to localized regions with high toner mass per unit area levels (high TMA). Retransfer defects may occur in halftones and solids, and in some cases is worst in halftones where there are highly localized high pile height regions, such as those on the order of 10's of microns. Retransfer can cause color shifts and a reduction of color gamut. Image blur, hollow character, and fusing defects such as poor fix and differential image gloss problems are also exacerbated by high TMA levels. Moreover, higher temperatures are often required to fuse high TMA images to the printed media, leading to decreased fuser roll life and increase run cost. At the same time, however, modern color printing quality requirements are constantly increasing, with customers demanding the improved imaging capabilities afforded by high TMA printing. Thus, there is a need for improved printing systems and techniques for high TMA printing to mitigate or avoid the aforementioned problems in multi-color printers and document processing systems.

BRIEF DESCRIPTION

The present disclosure provides document processing systems and methods that may be employed to reduce or mitigate the above mentioned problems by dividing one or more pages of a print job into two or more parts, with the first part being transferred and affixed to the printed medium prior to transferring and affixing the second part. The techniques outlined in the disclosure may be employed in any type or form of printing system and find particular utility in high TMA applications to combat retransfer, image blur, hollow character, and fusing defects while allowing hexachrome gamut extension, package printing, overcoats, and other applications that require high area coverage levels that are beyond the capabilities of conventional systems.

In accordance with certain aspects of the disclosure, a document processing system is provided, including multiple marking devices, such as xerographic marking stations, which transfer marking material onto a corresponding intermediate medium, such as a shared intermediate transfer belt (ITB), or individual intermediate transfer drums, etc. A controller is coupled with the marking devices to selectively cause transfer of toner, ink, or other form of marking material onto the intermediate medium in accordance with a print job. One or more transfer components transfer the marking material from the intermediate medium to a first side of a final print medium traveling along a first path, and an affixing component, such as a fuser, affixes the transferred marking material to the final print medium. The system also provides return apparatus, such as a duplex router and an inverter with a bypass control, to selectively direct the final print medium along a second path and to return the final print medium without inversion to the first path upstream of the at least one transfer component. The controller operates to selectively split one or more individual pages of a print job, such as pages having high TMA levels, into two or more parts or portions, each of which using a subset of the marking devices. For example, the controller may segment pages for which four or more color separations are required in a given area such that each portion uses three or fewer colors to mitigate retransfer and other problems discussed above. For such split print job pages, the controller causes a first subset of the marking devices to transfer the first print portion onto the intermediate medium, and this first portion is then transferred to a first side of the final print medium and fused or otherwise affixed thereto. The controller then operates the return apparatus to direct the final print medium along the second path and to return the final print medium without inversion to the first path upstream of the transfer component(s). The second subset of marking devices transfer the second print portion onto the intermediate medium, and the second portion is then transferred over the affixed first print portion on the first side of the final print medium. In this manner, the intermediate medium does not have high TMA levels at any one time, by which retransfer effects and other high TMA defects can be mitigated, while allowing virtually unlimited numbers of color separations to be used in any given area of the final print medium.

Further aspects of the disclosure relate to a method of printing an image onto a printable medium according to a print job using a plurality of marking devices. The method includes selectively splitting at least one individual page of a print job into at least a first print portion and a second print portion, transferring the first print portion on an intermediate medium using a first subset of the marking devices, transferring the first print portion from the intermediate medium to a first side of a final print medium, and affixing the first print portion to the final print medium. In addition, the method includes transferring the second print portion on the intermediate medium using a second subset of the marking devices, transferring the second print portion from the intermediate medium to the first side of a final print medium over the affixed first print portion, and affixing the second print portion to the final print medium. In one implementation, the method may also include directing the final print medium without inversion to a transfer component after the first print portion is affixed, such as by selectively directing the final print medium along a duplex path using a duplex router, and selectively returning the final print medium without inversion to the transfer component using a media inverter with a bypass control.

Still other aspects of the disclosure provide a document processing system having no intermediate transfer medium, which includes a plurality of marking devices for transferring marking material onto a final print medium traveling along a first path, and a controller operative to selectively cause one or more of the marking devices to transfer marking material onto the final print medium in accordance with a print job. The system further includes an affixing component downstream of the marking devices for affixing transferred marking material to the final print medium, and a print medium return apparatus that selectively returns the final print medium without inversion to the first path upstream of the marking devices. The controller is operative to selectively split one or more pages of a print job into two or more portions, each of which uses a subset of the marking devices, and for split print job pages to control a first subset of the marking devices to transfer the first print portion onto a first side of the final print medium, to control the affixing component to affix the transferred first print portion to the first side of the final print medium, and to control the return apparatus to return the final print medium without inversion to the first path upstream of the marking devices after the first print portion is affixed. The control also operates to control a second subset of the plurality of marking devices to transfer the second print portion on the final print medium, and to control the affixing component to affix the transferred second print portion over the affixed first print portion on the first side of the final print medium.

BRIEF DESCRIPTION OF THE DRAWINGS

The present subject matter may take form in various components and arrangements of components, and in various steps and arrangements of steps. The drawings are only for purposes of illustrating preferred embodiments and are not to be construed as limiting the subject matter.

DETAILED DESCRIPTION

Figure 1:
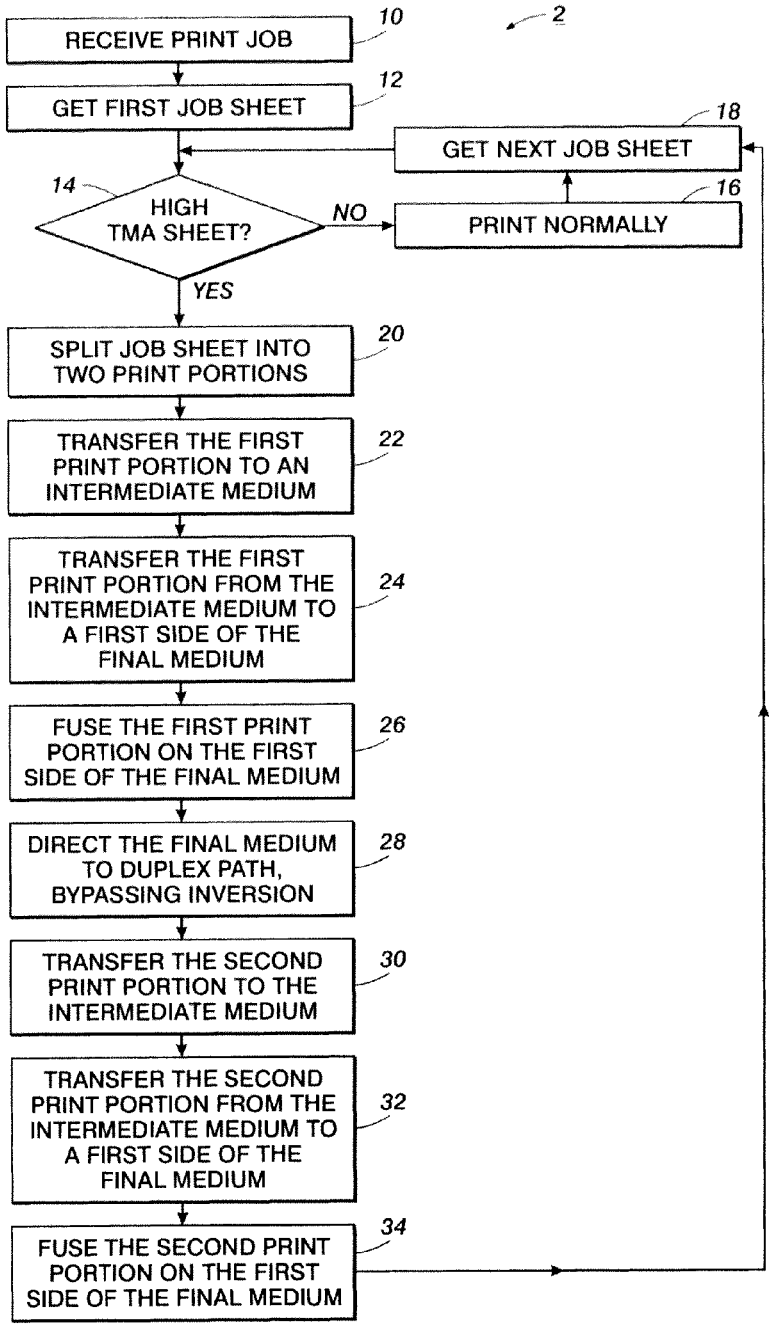
FIG. 1 is a flow diagram illustrating an exemplary printing method in accordance with one or more aspects of the disclosure.

Referring now to the drawing figures, several embodiments or implementations of the present disclosure are hereinafter described in conjunction with the drawings, wherein like reference numerals are used to refer to like elements throughout, and wherein the various features, structures, and graphical renderings are not necessarily drawn to scale. The disclosure relates to use of a multi-pass approach for printing high TMA images in which a first portion of a printed image is transferred and affixed to the final print medium before transfer and fusing of subsequent portions to minimize or reduce the adverse effects of retransfer, image blur, and hollow character problems, as well as poor fix, differential image gloss and other fusing defects.

As noted above, multi-color printing systems may suffer from retransfer problems, where all of the transfer nips for each station/engine are typically biased (energized) since each could be involved in image building somewhere across a given image. As a result, however, the high fields generated by the biasing of the stations for transferring toner can cause a region of toner already on the target medium from upstream stations to be scavenged from the medium by downstream stations. Such scavenging of toner reduces the pigment in that region on the medium, thereby reducing the intensity of the color and the Gamut (and/or shifts the color). The inventors have appreciated that retransfer to the downstream nips could be minimized by reducing the transfer field (perhaps to 0V/um) in each nip that does not transfer additional toner in order to significantly improve both the color macro-uniformity of the and the color accuracy of the image by minimizing scavenging by retransfer. The present disclosure contemplates the use of multi-pass transfer to mitigate such retransfer problems. As an example, consider a print job that includes one or more sheets requiring six colors with regions where the first three colors/stations form image areas with 200% to 300% of a solid image. Absent counter measures, the top layer in these areas may be severely scavenged by retransfer in the last three nips in normal operation.

The present disclosure provides a solution in which the print job can be divided into two or more portions or passes. In the first pass, the first three transfer devices would be energized, and the final three could be de-energized, and may be physically cammed or otherwise moved out of contact with the xerographic station, although not a strict requirement of the disclosure. In the second pass the last three stations would be energized/biased and the portions of the image requiring the last three stations would be built on the medium. This technique may be advantageously employed in accordance with various principles of the present disclosure to reduce retransfer and improve the color macro-uniformity and accuracy since one or more unneeded downstream transfer nips can be operated at very low (e.g., or zero) transfer fields during transfer of each portion of an image. In this regard, the retransfer mechanism tends to increase as the number of high field downstream nips increases, and as the pile height increases. By dividing the image into two or more passes per the various aspects of the disclosure, the total pile height traveling through the first transfer nips is reduced. For example, the disclosure may facilitate color ordering with a low L* (e.g. white) flood color located in the last station to enable printing to dark packaging substrates, and the other colors (e.g., a spot color and standard yellow, magenta, cyan, and black toners) located in the 5 upstream stations. In the first pass the last three nips could be energized to transfer the white flood background and the station 4 and 5 colors to the Intermediate belt and subsequently to the dark substrate. On the second pass the first three stations would be energized to build the remaining colors on the intermediate belt while the final three stations could be operated at zero transfer fields to minimize any retransfer in the last three nips. By limiting the pile height on the intermediate belt to less than or equal to three layers, the blur defect would also be minimized. The second pass image could then be transferred to the substrate containing the fused toner from the first pass. Since the pile height during transfer to the substrate was limited to three layers in each pass, the hollow character defect would be minimized. Hollow character occurs during transfer of high pile height images to the substrate. Since the pile height was limited to three layers in each pass, hollow character defects can be mitigated.

Moreover, the fuser never exceeds the maximum pile height limitation of three layers, thereby mitigating defects associated with poor fixing to the substrate and low gloss. The alternative would require operating the fuser at higher temperatures to accommodate more than three layers, which can dramatically increase the run cost by reducing the life of very expensive fuser components.

The various aspects of the disclosure are illustrated and described below in the context of exemplary multi-color document processing systems that employ multiple xerographic marking devices or stations in which toner marking material is first transferred to an intermediate medium and then retransferred to a final print medium to create images thereon in accordance with a print job. However, the techniques and systems of the present disclosure may be implemented in other forms of document processing or printing systems that employ any form of marking materials and techniques, such as ink-based printers, etc., wherein any such implementations and variations thereof are contemplated as falling within the scope of the present disclosure.

Figure 2:
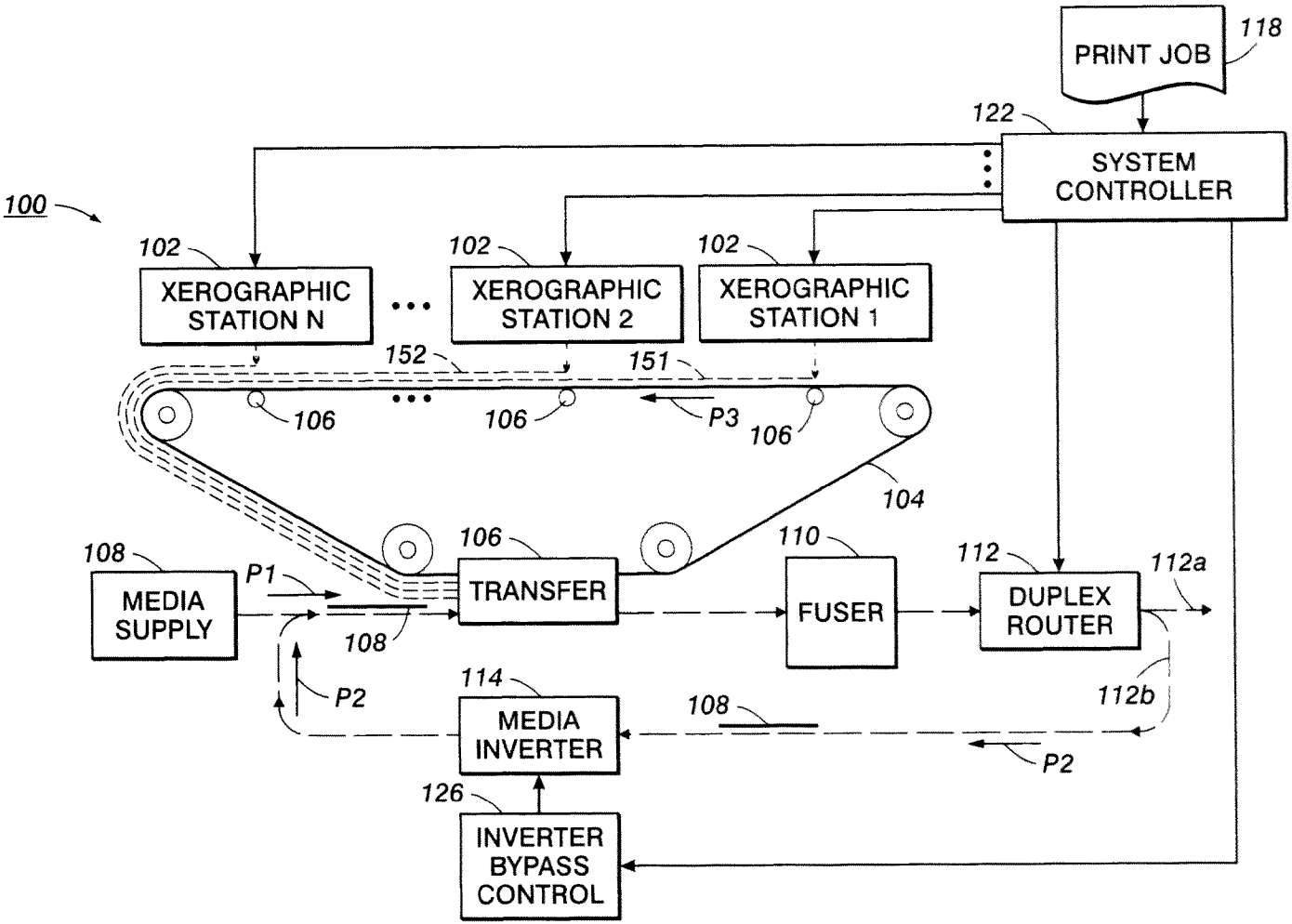
FIG. 2 is a system level diagram illustrating an exemplary multi-color document processing system with multiple xerographic marking devices disposed along a shared intermediate transfer belt (ITB) with a controller configured to segment one or more print job pages and to control operation of a duplex router and bypass controlled media inverter in accordance with several aspects of the disclosure.

FIG. 1 depicts an exemplary printing method 2, and FIG. 2 shows an exemplary multi-color document processing system 100 in accordance with the disclosure. The system 100 of FIG. 2 includes a plurality of marking devices 102 operative to transfer toner marking material onto an intermediate medium 104 that may or may not be a photoreceptor, in this case, a shared intermediate transfer belt (ITB) 104 traveling in a counter clockwise direction along a path P3 past the xerographic marking devices 102. Each xerographic station 102 in this embodiment includes a photoreceptor drum, a charging subsystem, a development subsystem, and a cleaning subsystem (not shown), by which the toner of a given color (e.g., cyan, magenta, yellow, black, or one or more spot toners or gamut extension colors such as orange or violet) is transferred electrostatically to the ITB 104 using a biased transfer roller (BTR) located on the inside of the ITB 104. Any integer number N marking devices 102 may be included in the system, where N is greater than or equal to two. In one exemplary implementation, the system 100 may include six such marking devices 102, as illustrated and described further below in connection with FIG. 15.

Figure 16:
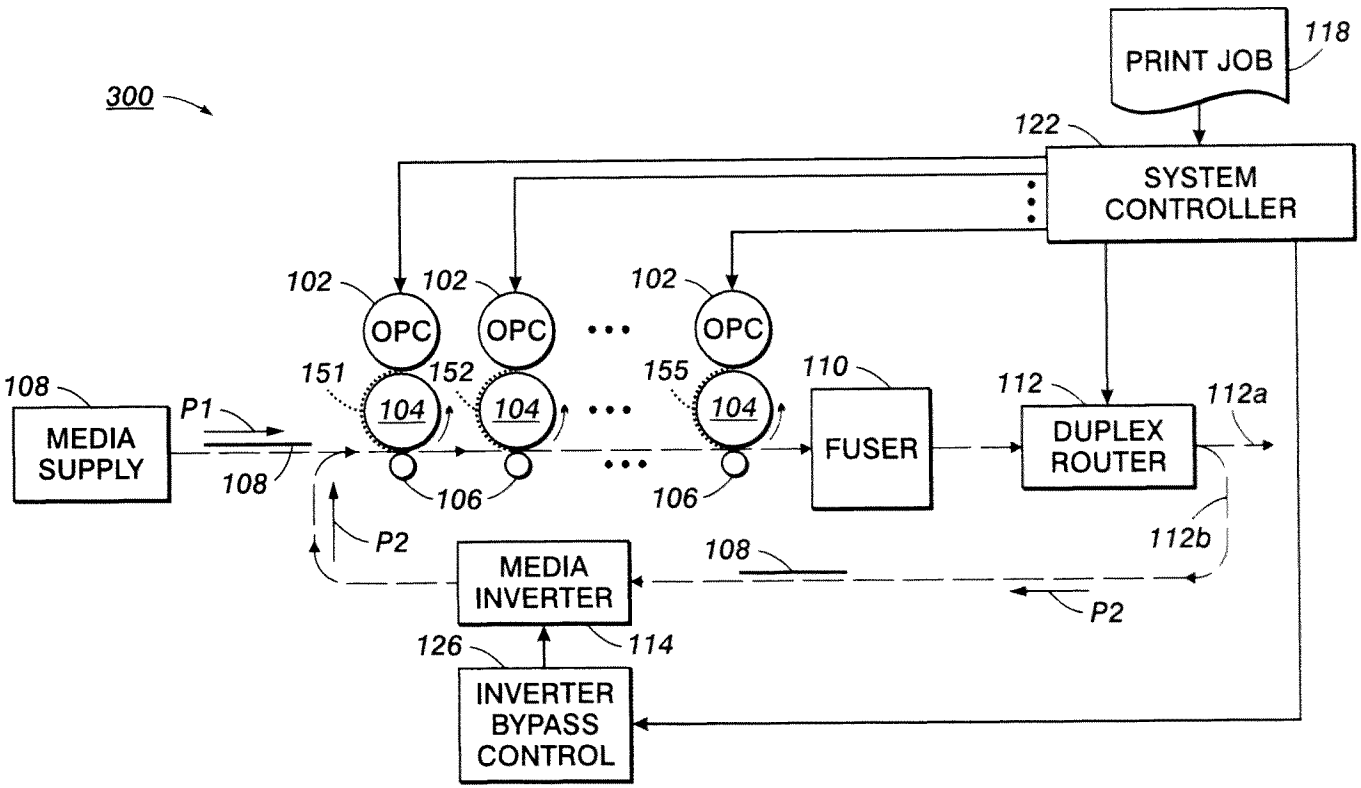
FIG. 16 is a system level diagram illustrating another exemplary multi-color document processing system with multiple xerographic marking devices and corresponding intermediate transfer drums (ITDs) and transfer components disposed along the path of final printable media in accordance with the disclosure.

The system 100 includes a transfer component 106 disposed downstream of the marking devices 102 along a lower portion of the path P3 to transfer marking material from the ITB 104 to a first (upper) side of a final print medium 108 (e.g., precut paper sheets in one embodiment) traveling along a path P1 from a media supply. FIG. 16 below illustrates another exemplary system 300 in which each marking device 102 has a corresponding dedicated intermediate transfer drum 104 and transfer system for subsequent transfer of toner marking material from the drum 104 to the printed media 108. After the transfer of toner to the print medium 108 at the transfer station 106 in FIG. 2, the final print medium 108 is provided to a fuser type affixing apparatus 110 on the path P1, at which the transferred marking material is fused to the print medium 108. The system 100 further includes a print medium return apparatus including a duplex router 112 that selectively directs the printed medium 108 in a direction 112*a* continuing along the first path P1 or diverts the medium 108 in a different direction 112*b* along a second (e.g., duplex bypass) path P2 to a media inverter 114 having a bypass control 126. When the media inversion is bypassed via the control 126, the printed medium 108 is returned without inversion to the first path P1 upstream of the transfer station 106. Otherwise, the duplex path P2 directs the medium 108 to the inverter 114 in which the media sheet 108 is physically inverted such that a second side of the sheet 108 is presented for transfer of marking material in the station 106 (e.g., for two-sided print jobs).

The system 100 includes a controller 122 that performs various control functions and may implement digital front end (DFE) functionality for the system 100, where the controller 122 may be any suitable form of hardware, software, firmware, programmable logic, or combinations thereof, whether unitary or implemented in distributed fashion in a plurality of components, wherein all such implementations are contemplated as falling within the scope of the present disclosure and the appended claims. The controller 122 receives incoming print jobs 118 and operates the marking devices 102 to transfer marking material onto the intermediate medium 104 in accordance with the print job 118. In the exemplary system 100, moreover, the controller controls the bypass control 126 of the media inverter 114 and the selective operation of the duplex router 112 in order to implement conventional two-sided duplex printing operation of the system 100 as well as selective multi-pass printing for high TMA print job pages in accordance with the disclosure.

In particular, the controller 122 in one embodiment determines which, if any, pages or sheets of a given incoming print job 118 involve the use of three or more colors. For instance, a particular job 118 may involve printing process colors on a black substrate medium 108 for a packaging application (package printing). A white toner spot color and one further color may be needed to print a bright, high L* solid area image 159 with other color images to be printed within the bright area. The controller 122 in this case divides the job page or sheet into two or more portions and operates the system components 102, 112, and 126 to implement a multi-pass printing operation so that three or fewer colors are transferred to the ITB 104 and then to the package medium 108 in each pass, with a fusing operation at the affixing station 110 before the next pass. In this example, the white background 159 is transferred to the intermediate belt 104 along with a first process color 152, and then to the final medium 108, followed by fusing to the medium 108 at the fuser 110. The final print medium 108 is then routed via the duplex router 112 (under control of the controller 112) to the duplex paper path P2, with the controller 122 bypassing the inversion in the media inverter 114 via the bypass control 126.

Figure 3:
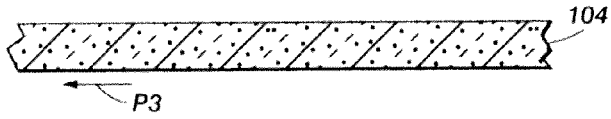
FIGS. 3-14 are simplified partial side elevation views illustrating segmented printing in the system of FIG. 2 in accordance with the disclosure.
Figure 4:
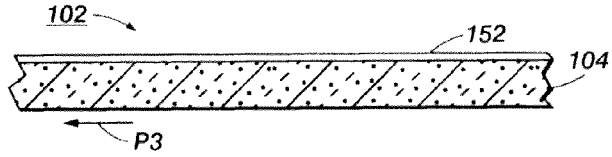
Figure 5:
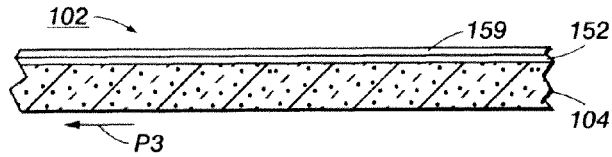
Figure 6:
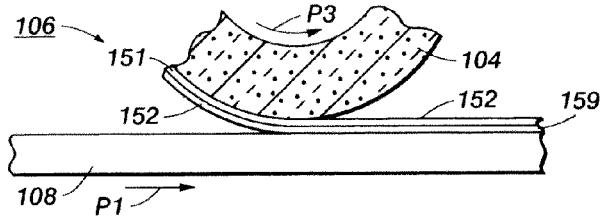
Figure 7:
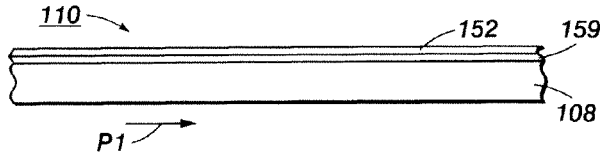
Figure 8:
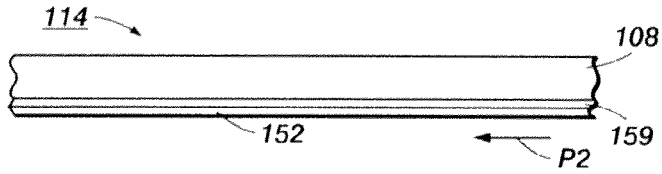

This operation is further illustrated in FIGS. 3-8, wherein FIG. 3 illustrates the ITB 104 traveling along the path P3 prior to encountering any of the selected subset of marking devices 102. In the illustrated example of FIGS. 2 and 4, the ITB 104 passes the first marking station 102 at which a first color toner 152 is transferred thereto, and as the ITB 104 passes the final (Nth) xerographic station 102, a second toner 159 (e.g., white) is transferred (FIG. 5) in accordance with the current print page portion of the print job 118. As shown in FIG. 6, with these two toner colors 159 and 152 thus transferred to the ITB 104, the ITB 104 then passes through the transfer station 106 at which the first portion 159, 152 is transferred to the final print medium 108 traveling along the first path P1. As shown in FIGS. 2 and 7, the print medium 108 then proceeds to the fuser 110 where the first portion 159, 152 is fused to the first (top) side of the substrate 108. Thereafter, as shown in FIG. 8, the final print medium 108 is routed via the duplex router 112 back along the duplex paper path P2 without inversion.

Figure 9:
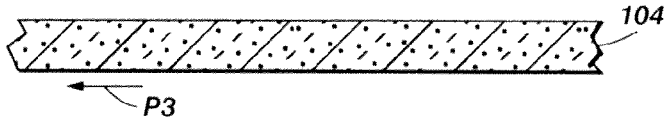
Figure 10:
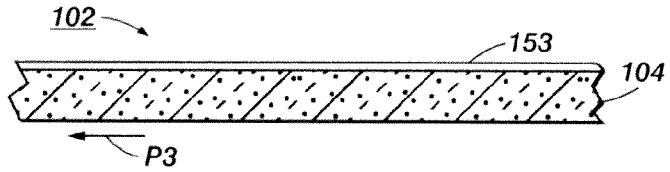
Figure 11:
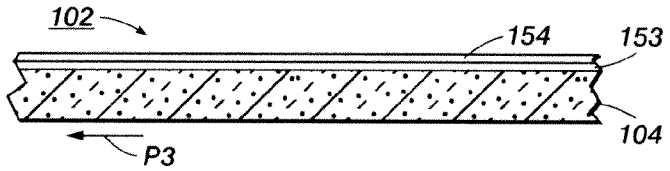
Figure 12:
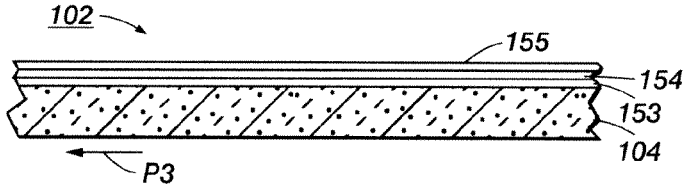
Figure 13:
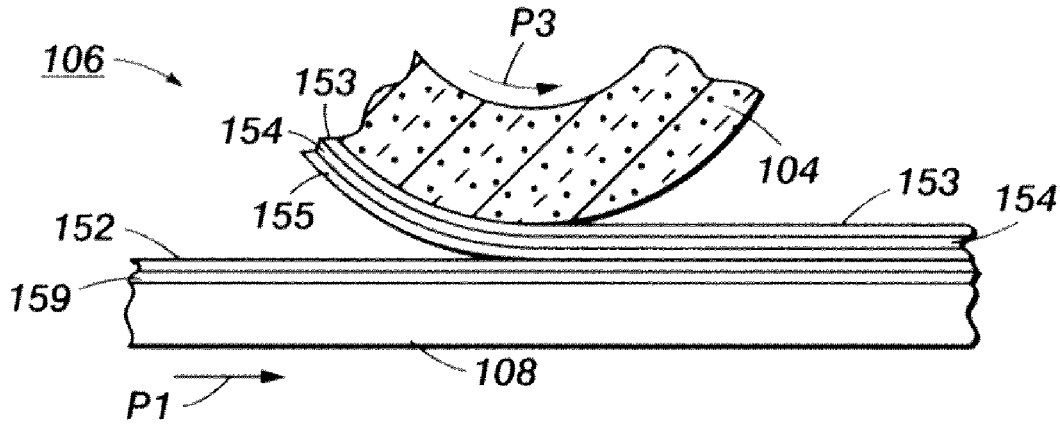
Figure 14:
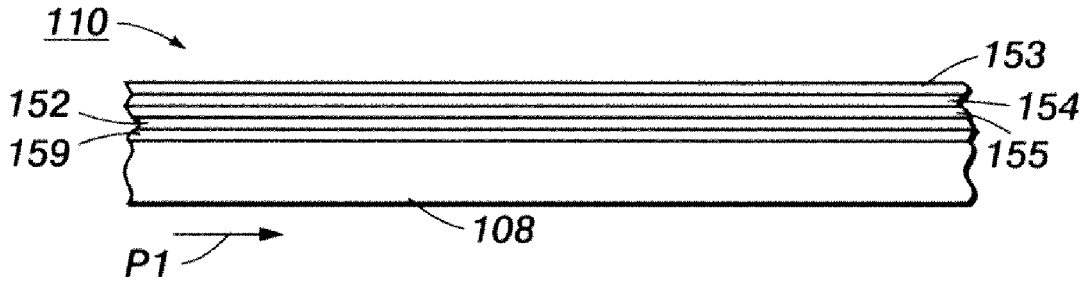

Referring now to FIGS. 2 and 9-13, in this manner, when the package media 108 is returned to the main (first) path P1, the first side with the fused white print page portion 159, 152 remains on top. Meanwhile, the ITB 104 is cleaned of any remnant toner after the first transfer at station 106, and again proceeds along the path P3 to the series of marking devices 102 as shown in FIG. 9. Continuing with this example, the process color image is a second print page portion, and this is selectively marked onto the ITB 104 by the appropriate second subset of marking devices 102 under control of the controller 122. As shown in FIGS. 10-12, this includes successive transfer of three additional colors of toner 153, 154, and 155 to the ITB 104. This second portion 153-155 (e.g., the process color image in this example) is then transferred (FIG. 13) at the component 106 over the affixed first print portion 159, 152 (over the white area) on the first side of the final print medium 108. The package medium 108 is then transferred along the first path P1 to the fuser 110 and the second print page portion is fused to the medium 108 as shown in FIG. 14. Further passes could be made in this fashion for printing more print page portions as needed, and the medium 108 could even be sent through the duplex path P2 for printing on the other (second or bottom) side, where the described multi-pass printing techniques of the disclosure could be used, if needed, for printing on the second side of the medium 108.

By this technique, the likelihood or severity of the above mentioned retransfer, blur, hollow characters, etc., can be reduced as each pass will only utilize a three or fewer colors. Thus, if a particular multi-color system 100 had an effective TMA limit, for instance a maximum 280% blend of YMCK to minimize or avoid retransfer or other problems, the advanced techniques of the present disclosure would allow printing of a 280% color YMCK image onto the previously transferred and fused 100% white area. In this manner, a two-pass technique could accommodate print job pages having images with TMA levels up to 560% without exceeding the 280% limitation of either the second transfer step or the fusing step, and higher TMA requirements could be met by utilizing further splitting into a third or further portion, with a corresponding increase in the number of passes employed in the system 100. As used in this discussion, a solid, single-separation toner area (without halftoning) is a 100% area coverage image. A two layer solid image would be therefore be referred to as a 200% image, and likewise a 3-layer solid image would be a 300% image. If there is a maximum 280% blend limit, one or more of the separations could be halftoned at less than 100%, for example a halftone blend of 100% Y+90% M+90% C would create a 280% process black blend.

Referring now to FIG. 1, the above described operation of the system 100 in FIG. 2 is depicted in the flow diagram in which a printing method 2 is presented. While the method 2 is illustrated and described below in the form of a series of acts or events, it will be appreciated that the various methods of the disclosure are not limited by the illustrated ordering of such acts or events. In this regard, except as specifically provided hereinafter, some acts or events may occur in different order and/or concurrently with other acts or events apart from those illustrated and described herein in accordance with the disclosure. It is further noted that not all illustrated steps may be required to implement a process or method in accordance with the present disclosure, and one or more such acts may be combined. The illustrated methods and other methods of the disclosure may be implemented in hardware, software, or combinations thereof, such as in the exemplary controller 122 in FIG. 2, in order to provide the multi-pass printing aspects illustrated and described herein.

The method 2 begins at 10 in FIG. 1 with receipt of a print job (e.g., print job 118 in FIG. 1). At 12, the first sheet or page of the job is scrutinized (e.g., by the controller 122), and a determination is made at 14 as to whether the sheet requires a high TMA level. If not (NO at 14), the process 2 proceeds to print the page/sheet normally at 16, and the next page or sheet is scrutinized at 18. When the process identifies a high TMA page or sheet (YES at 14), the job sheet is split or segmented into two or more portions at 20, preferably such that only a subset of the marking devices are required for each portion in order to ensure operation within any TMA limits of the system. At 22, the first print portion is transferred to an intermediate medium (e.g., a shared ITB medium 104 as in FIG. 2 or to a set of dedicated transfer drum mediums 104 as in the example of FIG. 16 below). The first portion is then transferred at 24 from the intermediate medium 104 to a first side of a final print medium (e.g., to print medium 108 in FIG. 2). This first portion is then fused at 26 to the medium, and the final print medium is directed at 28 to the duplex path with inversion bypassed. At 30, the second print portion is transferred on the intermediate medium 104 using a second subset of the marking devices 102, and this second portion is transferred at 32 from the intermediate medium 104 to the first side of a final print medium 108 over the affixed first print portion. Thereafter at 34, the second print portion is affixed (e.g., fused) to the medium 108, after which the process 2 returns to process any subsequent job pages or sheets.

Figure 15:
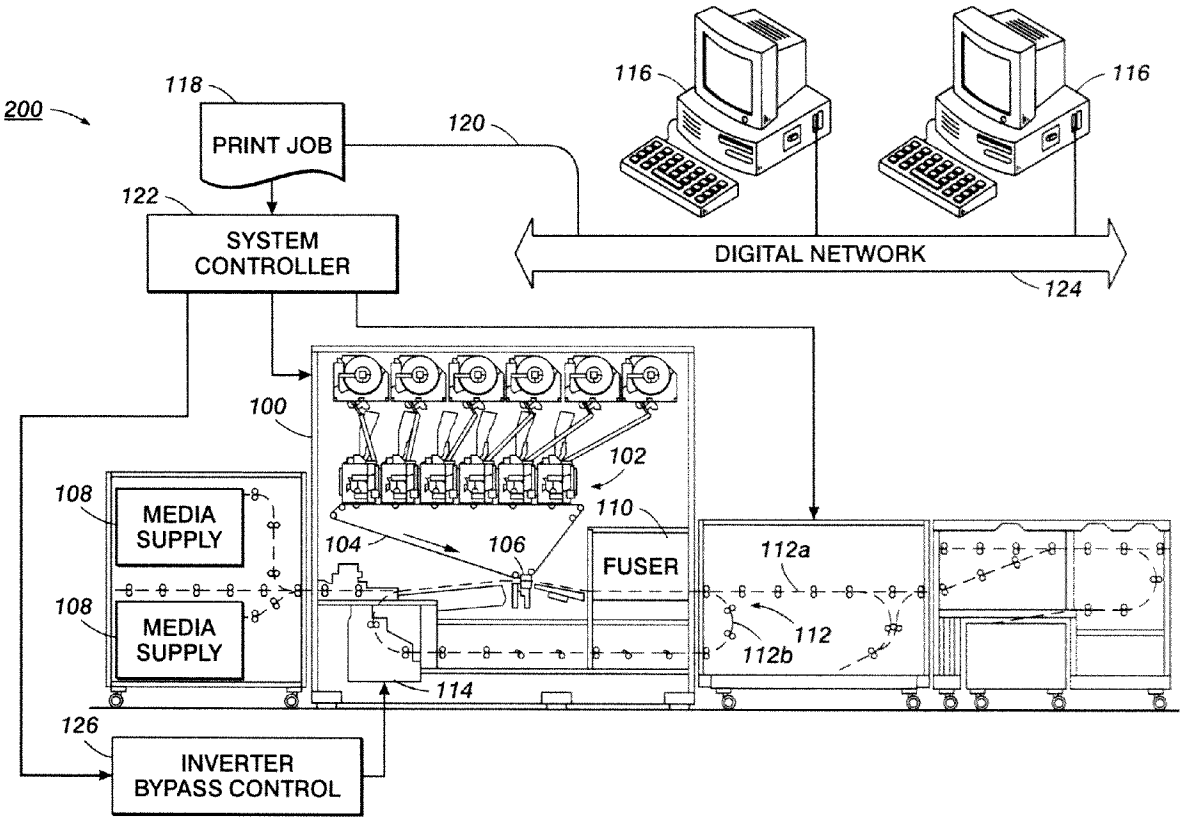
FIG. 15 is a detailed side elevation view illustrating an exemplary embodiment of the system of FIG. 2 in accordance with the present disclosure.

Referring now to FIG. 15, an exemplary system 200 is illustrated including an embodiment of the above-described document processing system 100 having six marking stations 102 disposed along the path of a shared intermediate transfer belt medium 104, along with a transfer station 106, a supply of final print media 108, a fuser 110, a bypass router 112, and a media inverter 114 with a bypass control 126 as described above. As shown in FIG. 15, moreover, this embodiment receives print jobs 118 at the controller 122 via an internal source such as a scanner (not shown) and/or from an external source, such as one or more computers 116 connected to the system 102 via one or more networks 124 and associated cabling 120, or from wireless sources. The print job execution may include printing selected text, line graphics, images, machine ink character recognition (MICR) notation, etc., on the front and/or back sides or pages of one or more sheets of paper or other printable media. In this regard, some sheets may be left completely blank in accordance with a particular print job 118, and some sheets may have mixed color and black-and-white printing. Execution of the print job 118, moreover, may include collating the finished sheets in a certain order, along with specified folding, stapling, punching holes into, or otherwise physically manipulating or binding the sheets. In certain embodiments the system 200 may be a stand-alone printer or a cluster of networked or otherwise logically interconnected printers, with each printer having its own associated print media source and finishing components including a plurality of final media destinations, print consumable supply systems and other suitable components.

The above system in FIG. 15 employs a belt type intermediate transfer medium 104 in a tandem arrangement of the marking devices 102, The inventors have appreciated that absent countermeasures such as those of the present disclosure, this architecture may be subject to defects including blur and image disturbances, hollow character defects, retransfer scavenging, and poor fusing and affixing for high TMA images built on the ITB 104 by marking station components for charging, exposing, development, and cleaning associated with OPC drums and associated initial transfer devices along the ITB 104.

FIG. 16 illustrates another exemplary system 300 in accordance with the disclosure, in which multiple xerographic marking devices 102 are individually associated with corresponding intermediate transfer drums (ITDs) 104 and transfer components 106 disposed along the path P1 of the final printable media 108. In this configuration, the multi-layer high TMA images are built on the final print media 108, and defects may occur including blur and image disturbances, retransfer scavenging, poor fusing, etc. To mitigate these adverse effects, the system controller 122 performs the selective splitting and multi-pass printing operation as generally described above in connections with FIGS. 1 and 2.

Figure 17:
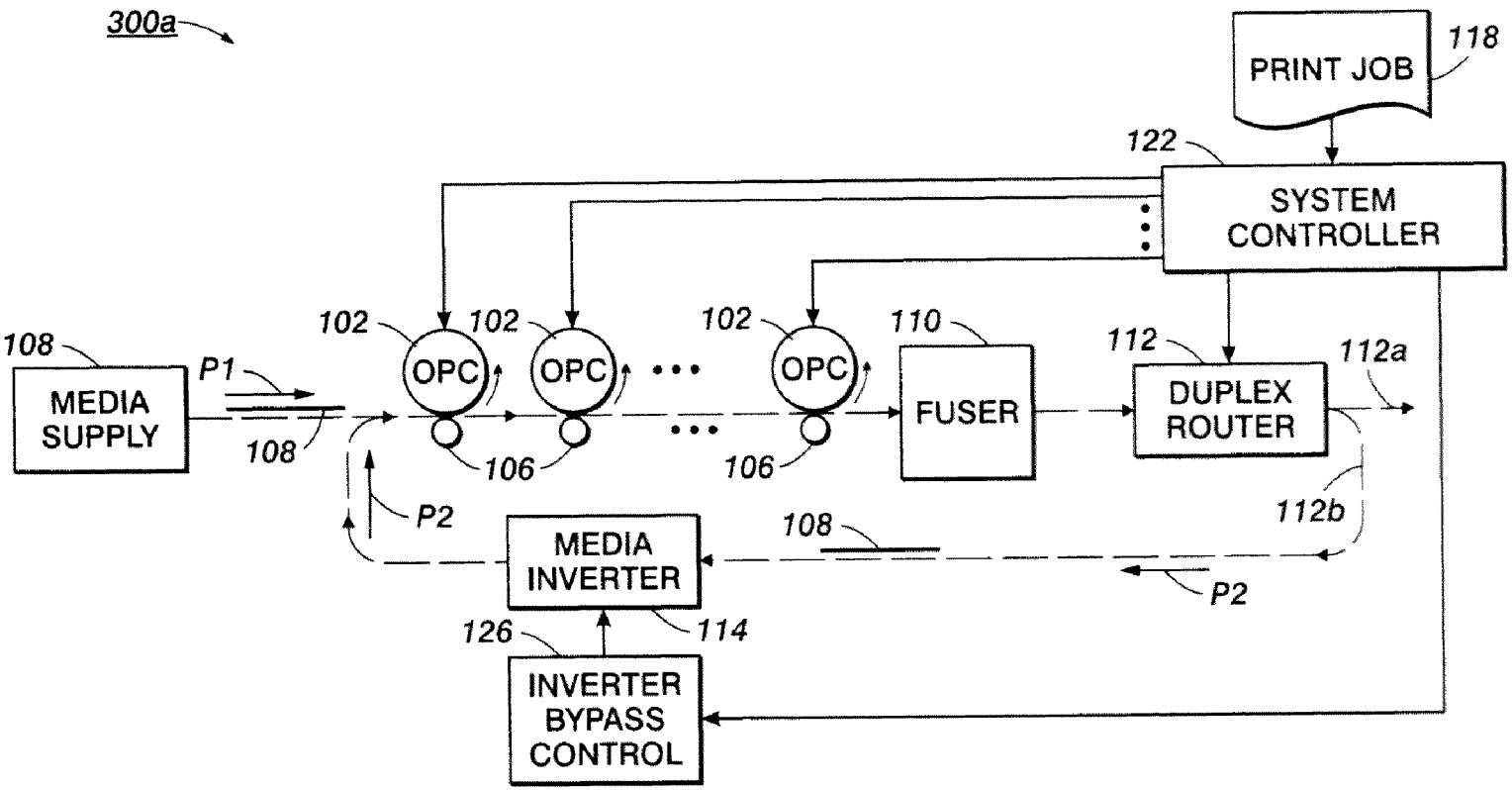
FIG. 17 is a system level diagram illustrating another exemplary multi-color document processing system with multiple xerographic marking devices and transfer components disposed along the path of final printable media for transferring toner thereto directly with no intermediate print medium in accordance with further aspects of the disclosure.

Referring now to FIG. 17, another multi-color document processing system 300*a* is illustrated with multiple xerographic marking devices 102 with no intermediate transfer medium (e.g., no transfer drums 104 as in the examples of FIG. 16 above), and having corresponding initial BTR type transfer components 106 disposed along the final print media path for transferring toner onto the final printable media 108. In this embodiment, like that of FIG. 16 above, high TMA images are built on the final print media 108, and absent countermeasures of the present disclosure, the system 300*a* may suffer from blur and image disturbances, retransfer scavenging, poor fusing, etc. To mitigate these adverse effects, the system controller 122 performs the selective splitting and multi-pass printing operation as generally described above in connections with FIGS. 1 and 2.

The system controller 122 in this example performs selective splitting and multi-pass printing operation as generally described above to reduce or avoid such defects. In particular, the controller 122 selectively causes one or more of the marking devices 102 to transfer marking material onto the final print medium 108 in accordance with a print job 118, and a fuser type affixing component 110 located along the path P1 downstream of the marking devices 102 operates to affix transferred marking material to the final print medium 108. The print medium return apparatus 114 and control 126 operate to selectively return the final print medium 108 without inversion to the path P1 upstream of the marking devices 102, with the controller 118 selectively splitting one or more individual pages of a print job 118 into at least a first print portion and a second print portion, each or which using a subset of the marking devices 102.

In this embodiment, moreover, the controller 122 is operative for such split print job pages to control a first subset of the devices 102 to transfer the first print portion onto a first side of the final print medium 108, and to control the fuser 110 to affix the transferred first print portion to the first side of the final print medium 108. The controller 122 also controls the return apparatus 114 via control 126 to return the medium 108 without inversion to the path P1 upstream of the marking devices 102 after the first print portion is affixed to the first side, to control a second subset of the marking devices 102 to transfer the second print portion on the medium 108, and to control the fuser 110 to affix the transferred second print portion over the affixed first print portion on the first side of the final print medium 108.

Figure 18:
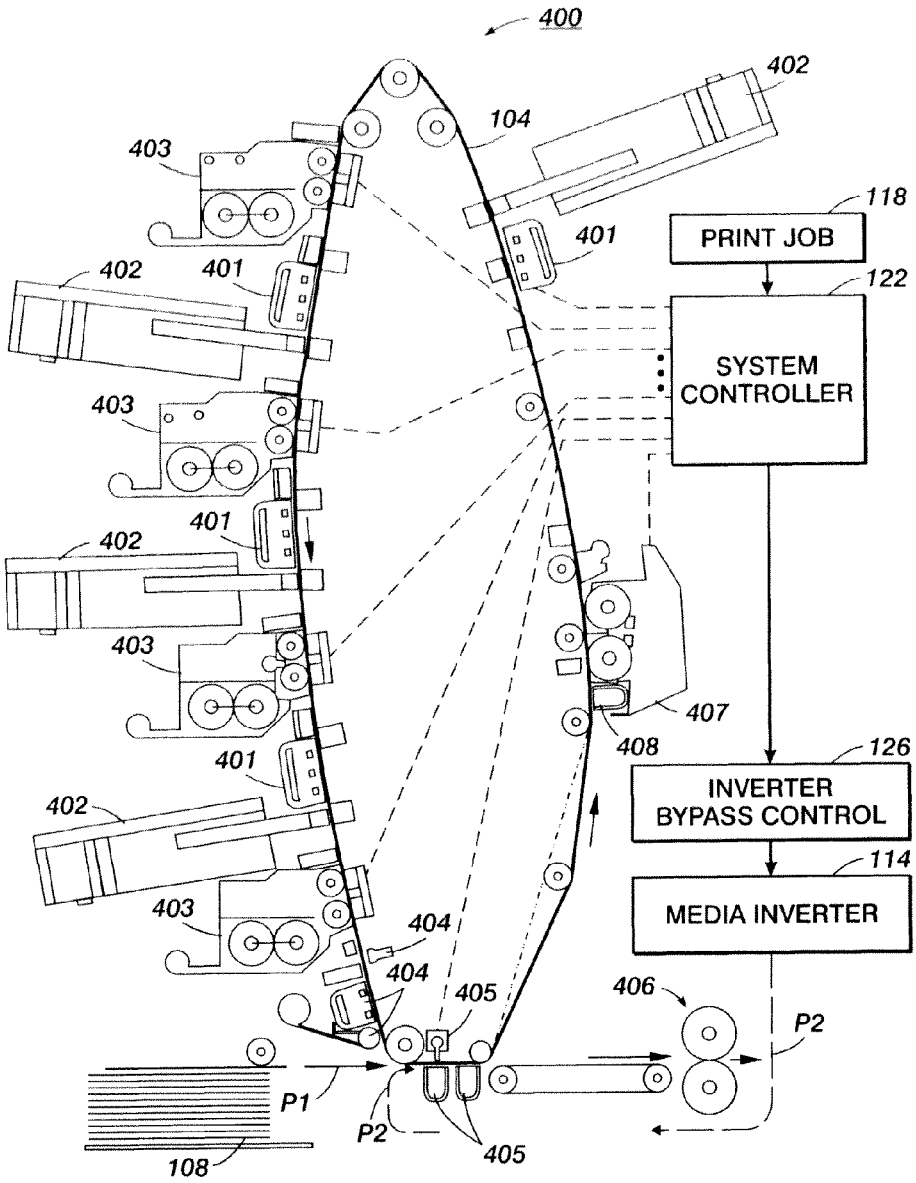
FIG. 18 is a system level diagram illustrating yet another exemplary multi-color document processing system with multiple xerographic marking devices and corresponding intermediate transfer belt (ITB) and transfer components disposed along the path of final printable media in accordance with the disclosure.

FIG. 18 depicts an exemplary image on image type printing system 400 in which high TMA images are initially built on a photoreceptor belt 104 via tandem configured charge and recharge components 401, exposing components 402, developers 403. The system 400 further includes pre-transfer and transfer components 404 and 405, respectively for performing a transfer of the built image from the photoreceptor belt 104 to the final print media 108, as well as media return apparatus 114, 126 and a system controller 122 as described above. The system 400, moreover, includes a fuser type affixing apparatus 406 as well as cleaning and erasing components 407 and 408, respectively. The inventors have further appreciated that absent the selective job page splitting and controlled media return without inversion of the present disclosure, this type of system 400 is susceptible to blur and image disturbance, hollow character defects, development scavenging, and poor fusing and affixing. Accordingly, the controller 122 is adapted to selectively split one or more individual print job pages into two or more portions, to cause a first print portion to be transferred by one subset of the marking devices 401, 402, and 403 to the photoreceptor belt 104, and to transfer this portion at the component 405 to one side of the media 108. The first print portion is then fused to the media in the fuser 406 and returned to the first path P1 via the components 114, 126 without inversion. The controller 122 causes the second print portion to be transferred to the photoreceptor belt 104 and transfers this second portion over the fused first portion on the media 108 before subsequently fusing this second portion to the media containing the previously fused first portion of the image.

The above examples are merely illustrative of several possible embodiments of the present disclosure, wherein equivalent alterations and/or modifications will occur to others skilled in the art upon reading and understanding this specification and the annexed drawings. In particular regard to the various functions performed by the above described components (assemblies, devices, systems, circuits, and the like), the terms (including a reference to a "means") used to describe such components are intended to correspond, unless otherwise indicated, to any component, such as hardware, software, or combinations thereof, which performs the specified function of the described component (i.e., that is functionally equivalent), even though not structurally equivalent to the disclosed structure which performs the function in the illustrated implementations of the disclosure. In addition, although a particular feature of the disclosure may have been disclosed with respect to only one of several embodiments, such feature may be combined with one or more other features of the other implementations as may be desired and advantageous for any given or particular application. Also, to the extent that the terms "including", "includes", "having", "has", "with", or variants thereof are used in the detailed description and/or in the claims, such terms are intended to be inclusive in a manner similar to the term "comprising". It will be appreciated that various of the above-disclosed and other features and functions, or alternatives thereof, may be desirably combined into many other different systems or applications, and further that various presently unforeseen or unanticipated alternatives, modifications, variations or improvements therein may be subsequently made by those skilled in the art which are also intended to be encompassed by the following claims.

The invention claimed is:

1. A method of printing an image onto a printable medium according to a print job using a plurality of marking devices, the method comprising:

selectively splitting at least one individual page of a print job into at least a first print portion and a second print portion;

transferring the first print portion on an intermediate medium using a first subset of the marking devices;

transferring the first print portion from the intermediate medium to a first side of a final print medium;

affixing the first print portion to the final print medium;

transferring the second print portion on the intermediate medium using a second subset of the marking devices;

transferring the second print portion from the intermediate medium to the first side of a final print medium over the affixed first print portion; and affixing the second print portion to the final print medium.

2. The method of claim 1, further comprising directing the final print medium without inversion to a transfer component after the first print portion is affixed.

3. The method of claim 2, wherein directing the final print medium without inversion to a transfer component after the first print portion is affixed comprises:

selectively directing the final print medium along a duplex path using a duplex router; and selectively returning the final print medium without inversion to the transfer component using a media inverter with a bypass control.

4. The method of claim 3, wherein the plurality of marking devices includes at least four marking devices individually associated with a different color separation.

5. The method of claim 4, wherein the intermediate medium is a shared intermediate medium traveling along a path, and wherein the plurality of marking devices are located along the path and individually operative to transfer marking material onto the shared intermediate medium.

6. The method of claim 5, wherein selectively splitting at least one individual page of the print job is done based on the number of color separations for the at least one individual page of the print job.

7. The method of claim 6, wherein at least one individual page of a print job is selectively split into print portions that each use a subset of three or fewer marking devices.

8. The method of claim 5, wherein at least one individual page of a print job is selectively split into print portions that each use a subset of three or fewer marking devices.

9. The method of claim 4, wherein selectively splitting at least one individual page of the print job is done based on the number of color separations for the at least one individual page of the print job.

10. The method of claim 9, wherein at least one individual page of a print job is selectively split into print portions that each use a subset of three or fewer marking devices.

11. The method of claim 4, wherein at least one individual page of a print job is selectively split into print portions that each use a subset of three or fewer marking devices.

12. The method of claim 3, wherein the intermediate medium is a shared intermediate medium traveling along a path, and wherein the plurality of marking devices are located along the path and individually operative to transfer marking material onto the shared intermediate medium.

13. The method of claim 12, wherein selectively splitting at least one individual page of the print job is done based on the number of color separations for the at least one individual page of the print job.

14. The method of claim 13, wherein at least one individual page of a print job is selectively split into print portions that each use a subset of three or fewer marking devices.

15. The method of claim 12, wherein at least one individual page of a print job is selectively split into print portions that each use a subset of three or fewer marking devices.

16. The method of claim 1, comprising:

selectively directing the final print medium along a duplex path using a duplex router; and selectively returning the final print medium without inversion to the transfer component using a media inverter with a bypass control.

17. The method of claim 1, wherein the plurality of marking devices includes at least four marking devices individually associated with a different color separation.

18. The method of claim 1, wherein the intermediate medium is a shared intermediate medium traveling along a path, and wherein the plurality of marking devices are located along the path and individually operative to transfer marking material onto the shared intermediate medium.

19. The method of claim 1, wherein selectively splitting at least one individual page of the print job is done based on the number of color separations for the at least one individual page of the print job.

20. The method of claim 1, wherein at least one individual page of a print job is selectively split into print portions that each use a subset of three or fewer marking devices.

* * * * *